United States Patent [19]

Ljungkvist

[11] Patent Number: 4,783,943

[45] Date of Patent: Nov. 15, 1988

[54] DEVICE FOR FLOOR VENTILATION

[75] Inventor: Stig-Ake Ljungkvist, Skovde, Sweden

[73] Assignee: Nyboverken AB, Skovde, Sweden

[21] Appl. No.: 850,016

[22] Filed: Apr. 10, 1986

[51] Int. Cl.[4] ..... E04B 5/52

[52] U.S. Cl. ..... 52/480; 52/403

[58] Field of Search ..... 52/480, 367, 368, 371, 52/374, 376, 729, 732, 393, 403

[56] References Cited

U.S. PATENT DOCUMENTS

| | | | |
|---|---|---|---|
| 1,651,072 | 11/1927 | Smallman | 52/367 |
| 2,743,487 | 5/1956 | Kuhlman | 52/367 X |
| 3,383,818 | 5/1968 | Tatum | 52/371 |
| 3,596,422 | 8/1971 | Boettcher | 52/368 |

FOREIGN PATENT DOCUMENTS

| | | | |
|---|---|---|---|
| 166543 | 1/1950 | Austria | 52/480 |
| 2103383 | 8/1972 | Fed. Rep. of Germany | 52/480 |
| 1050091 | 1/1954 | France | 52/368 |
| 1310465 | 10/1962 | France | 52/376 |
| 1514823 | 2/1968 | France | 52/368 |
| 284177 | 1/1965 | Netherlands | 52/376 |
| 382416 | 11/1964 | Switzerland | 52/368 |

*Primary Examiner*—Carl D. Friedman

*Attorney, Agent, or Firm*—Stevens, Davis, Miller & Mosher

[57] ABSTRACT

The invention helps to find a way for creating a ventilated space on an existing floor damaged by moisture. On this way the resulting effects from moisture are held low. The invention consists of a moulding with the form of an inverted t. Holes (2) are located for attachment of the moulding to the lower floor. The lower part of the moulding has also at right angle going passages (5). The supports (4), shaped of the moulding on the either side, are used to carry plate-type material, which between two moldings shaped the ventilated space.

2 Claims, 1 Drawing Sheet

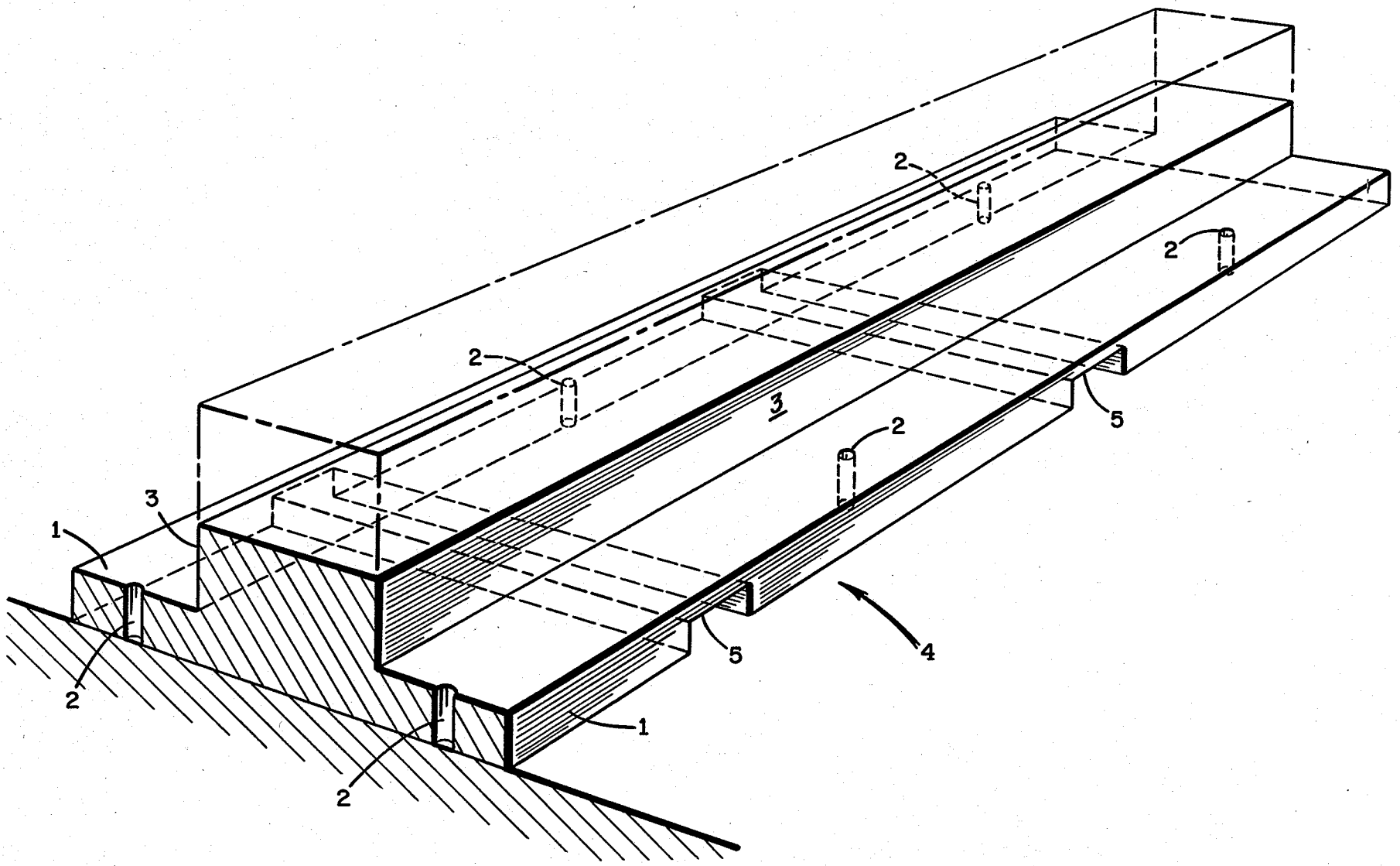
1
2
3
4
5

DEVICE FOR FLOOR VENTILATION

The present invention is an improvement of the invention described in the Swedish application No. 8401586-6. In this application an arrangement is described with the aid of which a space can be created between an already existing floor and a new floor. The arrangement is then used to ventilate the intermediate space thus produced with a view to partly eliminating any discomfort due to defects resulting from moisture or getting rid of radon emanating from bed-rocks underneath the floor.

The application No. 8401568-6 relates to a lining on wooden joists turned downward towards the old floor. The lining consists of non-rotting material. Use may be made of wooden joists, a method common in Sweden and well known for constructing a raised floor.A raised floor in a different sense is, to be sure, a floor for use in computer centres, where the space produced is used to accommodate cables linking the computer units. Occasionally also service ducts for air or water are accommodated in such spaces.

The present invention thus relates to a similar arrangement as that described in No. 8401586-6 but different in that no use is made of lined wooden joists. For it has been shown that there is a requirement for entirely wood-less construction. In particular, such a construction comprising wood may become unnecessarily complicated and, as a result, unnecessarily costly.

The arrangement consists of mouldings produced from a non-rotting material with a cross-section in the shape of an inverted T. The supports thus produced carry the plate-type material creating the ventilated space. This plate-type material may consist of several different components. With floors damaged by moisture, for instance, steps must be taken to ensure that the material keeps out the ventilation air, which may be cold. Hence an insulation may form part of the plate-type material. Possible insulating materials are glass-, mineral- or slag-wool as well as organic foams based on polystyrene, phenol or polyurethanes (including isocyanates).

If it is desired to prevent radon gas from penetrating the floor a gas-tight construction may be provided using a material capable of being welded to the mouldings, i.e. a plastic-based material. With such a solution only a very moderate differential pressure is needed in order to be able effectively to prevent the rise of radon while at the same time the slight ventilation need not negatively affect the energy balance of the building, which might otherwise be the case.

FIG. 1 is provided for a more detailed description of the arrangement. This figure shows the moulding in simple perspective. The lower part (1) is fixed by nailing or screwing to the base. In this connection use is made of the nail or screw holes contained in this part (2). A higher part extending along the entire length of the arrangement (3) is provided, not necessarily but practically, at the centre. This part is intended to serve as a support for the new flooring material resting on top. It is very advantageous if the material can be screwed and nailed without preparing holes so that the flooring material can be easily secured.

Hence the supports (4) thus formed always serve as seats for plate-type material extending between two mouldings and supply a base for screwing or nailing the plate-type material thereto.

It has proved that the arrangement can be produced from several materials. E.g. from aluminum. However, this material has the disadvantage that all holes must be drilled in advance. That is why foamed plastic consisting e.g. of PVC has proved to be very advantageous.

The upper, higher part (3) may vary in height, as the requirement for ventilated space varies. Furthermore passages may be provided at right angles to the longitudinal direction of the arrangement in order to balance out the pressures in different ventilated spaces formed between two arrangements. The passages (5) may be milled in the lower part of the arrangement.

I claim:

1. A spacer device for positioning on an existing floor and directly and solely supporting new flooring and material positioned between said existing floor and new flooring consisting of a bar defining a horizontal section and a vertical section of equal length, said horizontal section being wider than said vertical section said vertical section being joined to one side of said horizontal section at an intermediate portion thereof, said horizontal section having vertical holes therethrough on either side of said vertical section and having transverse grooves therein on a side opposite said vertical section.

2. The spacer of claim 1 formed solely of non-rotting cellular plastic material.

* * * * *